US011253988B1

(12) United States Patent
Hsieh

(10) Patent No.: US 11,253,988 B1
(45) Date of Patent: Feb. 22, 2022

(54) TOOL HOLDER

(71) Applicant: Chih-Chien Hsieh, Taichung (TW)

(72) Inventor: Chih-Chien Hsieh, Taichung (TW)

( * ) Notice: Subject to any disclaimer, the term of this patent is extended or adjusted under 35 U.S.C. 154(b) by 0 days.

(21) Appl. No.: 17/315,689

(22) Filed: May 10, 2021

(51) Int. Cl.
*B25H 3/00* (2006.01)
*B25H 3/04* (2006.01)

(52) U.S. Cl.
CPC ..... *B25H 3/003* (2013.01); *B25H 3/04* (2013.01)

(58) Field of Classification Search
CPC ..... B25H 3/003; B25H 3/04; B25H 3/06
USPC ..... 211/70.6
See application file for complete search history.

(56) References Cited

U.S. PATENT DOCUMENTS 5,467,874 A * 11/1995 Whitaker ..... B25B 23/0035 206/378
6,581,894 B1 * 6/2003 Tong ..... A47F 5/0006 206/378
6,854,607 B2 * 2/2005 Tong ..... B25H 3/003 206/378
6,991,105 B2 * 1/2006 Winnard ..... B25H 3/003 206/378
7,152,747 B2 * 12/2006 Wang ..... A47F 5/0006 211/70.6
7,264,213 B2 * 9/2007 Liu ..... A47F 5/0006 206/378
7,658,284 B2 * 2/2010 Lin ..... B25H 3/003 206/378
7,841,480 B2 * 11/2010 Hsieh ..... B25H 3/06 211/70.6
8,096,516 B2 * 1/2012 Shiao ..... B25H 3/04 248/298.1
9,247,832 B2 * 2/2016 Chang ..... B25H 3/04
9,339,127 B1 * 5/2016 Chen ..... B25H 3/04
9,782,890 B2 * 10/2017 Hsieh ..... B25H 3/003
10,632,606 B1 * 4/2020 Wang ..... B25H 3/006
11,091,778 B2 * 8/2021 Winnard ..... A61K 39/205
2002/0130235 A1 * 9/2002 Tong ..... A47F 7/024 248/291.1

(Continued)

FOREIGN PATENT DOCUMENTS

JP 3207151 U * 10/2016 ..... B25H 3/04
TW 580977 U 3/2004
TW M591462 U 3/2020

*Primary Examiner* — Stanton L Krycinski
(74) *Attorney, Agent, or Firm* — Egbert, McDaniel & Swartz, PLLC

(57) ABSTRACT

A tool holder includes a base, a rotating sleeve, a segmented positioning member and an anti-dropping member. The main feature is that the base includes the chassis and the convex shaft formed with the abutment plate. The rotating sleeve includes a seat and a quadrangular sleeve joint with a hollow chamber formed therein. The seat is formed with a perforation for the convex shaft of the base and the abutment plate to pass through and enter the hollow chamber. The segmented positioning member includes a blocking part formed on the convex shaft, and first and second inserting parts formed at the corresponding positions of the seat. The anti-dropping member is located in the hollow chamber, and includes the anti-dropping flange formed on the convex shaft; thereby forming both the segmented positioning member and the anti-dropping member set within the projection range of the lateral contour of the quadrangular sleeve joint.

8 Claims, 12 Drawing Sheets

(56) References Cited

U.S. PATENT DOCUMENTS

| | | | | |
|---|---|---|---|---|
| 2004/0188366 | A1* | 9/2004 | Tong | B25H 3/003 211/70.6 |
| 2004/0211691 | A1* | 10/2004 | Winnard | B25H 3/003 206/378 |
| 2005/0218023 | A1* | 10/2005 | Winnard | B25H 3/003 206/378 |
| 2005/0221664 | A1* | 10/2005 | Winnard | B25H 3/003 439/510 |
| 2005/0230587 | A1* | 10/2005 | Yang | A47F 5/0006 248/314 |
| 2007/0034771 | A1* | 2/2007 | Liu | A47F 5/0006 248/682 |
| 2009/0001111 | A1* | 1/2009 | Lin | B25H 3/003 224/245 |
| 2010/0025562 | A1* | 2/2010 | Shiao | B25H 3/04 248/682 |
| 2010/0065520 | A1* | 3/2010 | Hsieh | B25H 3/06 211/70.6 |
| 2014/0209780 | A1* | 7/2014 | Chang | F16M 13/005 248/551 |
| 2014/0305824 | A1* | 10/2014 | Hsieh | B25H 3/04 206/378 |
| 2015/0165615 | A1* | 6/2015 | Lee | B65D 25/22 206/372 |
| 2017/0043475 | A1* | 2/2017 | Hsieh | B25H 3/003 |
| 2020/0101590 | A1* | 4/2020 | Winnard | B25H 3/04 |
| 2021/0060761 | A1* | 3/2021 | Chang | B25H 3/003 |

* cited by examiner

TOOL HOLDER

CROSS-REFERENCE TO RELATED U.S. APPLICATIONS

Not applicable.

BACKGROUND OF THE INVENTION

1. Field of the Invention

The present invention relates generally to a tool holder, and more particularly to an innovative structure type of a tool holder.

2. Description of Related Art Including Information Disclosed Under 37 CFR 1.97 and 37 CFR 1.98

The present invention discusses a tool holder, especially a tool holder form for placing sleeving tools (e.g. sleeves).

This tool holder comprises a base and a rotatable binder. The common structure type can refer to the disclosure of Taiwan patent certificate No. M591462 "sleeve seat" utility patent case declared on Mar. 1, 2020. The binder disclosed in the known technology has a quadrangular driving part for setting the sleeve. A storage slot in outside diameter larger than the quadrangular driving part is formed in one end of the quadrangular driving part, so as to set the cylinder formed on the base. The storage slot and cylindrical structure are provided with an anti-dropping component and a segmented positioning element, wherein the anti-dropping component prevents the base and binder from being disengaged from each other, the segmented positioning element provides inserting positioning segmented hand feeling at two steering angles when the binder is rotating.

However, there are still some problems in the practical application of said sleeve seat structure type. For example, as the anti-dropping member and the segmented positioning member are arranged in the peripheral region of the quadrangular driving part, in this structural framework, it is difficult to further reduce the outside diameter of the known sleeve seat, so that it is difficult to respond to the design development trend of tool product miniaturization, that is really an important technical topic of the circle.

BRIEF SUMMARY OF THE INVENTION

The primary objective of the present invention is to provide a tool holder. The technical problem to be solved is how to develop a novel tool holder structure type with more ideal practicability. The tool holder is used for placing the existing sleeving tool. The sleeving tool forms a quadrangular mouthpiece.

Based on said objective, the technical characteristic of problem solving of the present invention is that the tool holder includes a base, a rotating sleeve, a segmented positioning member and an anti-dropping member.

Said base includes a chassis and a convex shaft. Said convex shaft is formed with at least one abutment plate extended laterally. Said rotating sleeve includes a seat and a quadrangular sleeve joint. Said quadrangular sleeve joint is provided for setting the quadrangular mouthpiece of the sleeving tool. A hollow chamber is formed in the quadrangular sleeve joint, and said hollow chamber is formed with at least one elastic piece. A blocking part is formed on the outside of the elastic piece. When said elastic piece is propped by the at least one abutment plate in hard mode, said blocking part localizes the quadrangular mouthpiece to prevent the sleeving tool from dropping out. Said seat is formed with a perforation, and the contour of the perforation must allow the convex shaft of the base and the at least one abutment plate to pass through and enter said hollow chamber.

Said segmented positioning member includes at least one blocking part and a first inserting part and a second inserting part or the at least one blocking part to optionally engage with, where at least one blocking part is formed on said convex shaft of the base. Said first inserting part and said second inserting part are formed in the corresponding positions of the seat.

Said anti-dropping member is located in the hollow chamber, including an anti-dropping flange laterally expanded and formed at the predetermined height of the convex shaft of said base. Said anti-dropping flange is elastic, and the outside diameter thereof must be larger than the corresponding aperture of the perforation. When said convex shaft passes through the perforation, said anti-dropping flange forcibly penetrates into said hollow chamber through the perforation in the state of interference fit, so as to prevent said convex shaft from backward dropping out of said hollow chamber.

Thereby, both said segmented positioning member and said anti-dropping member are arranged in the projection range of the lateral contour of the quadrangular sleeve joint.

The main effect and advantage of the present invention are the innovative configuration that both the segmented positioning member and anti-dropping member are arranged in the projection range of the lateral contour of the quadrangular sleeve joint, so that the outside diameter of the tool holder product can be further reduced, better responding to the design development trend of tool product miniaturization, there are practical progressiveness and better benefit of industrial use.

DETAILED DESCRIPTION OF THE INVENTION

Figure 1:
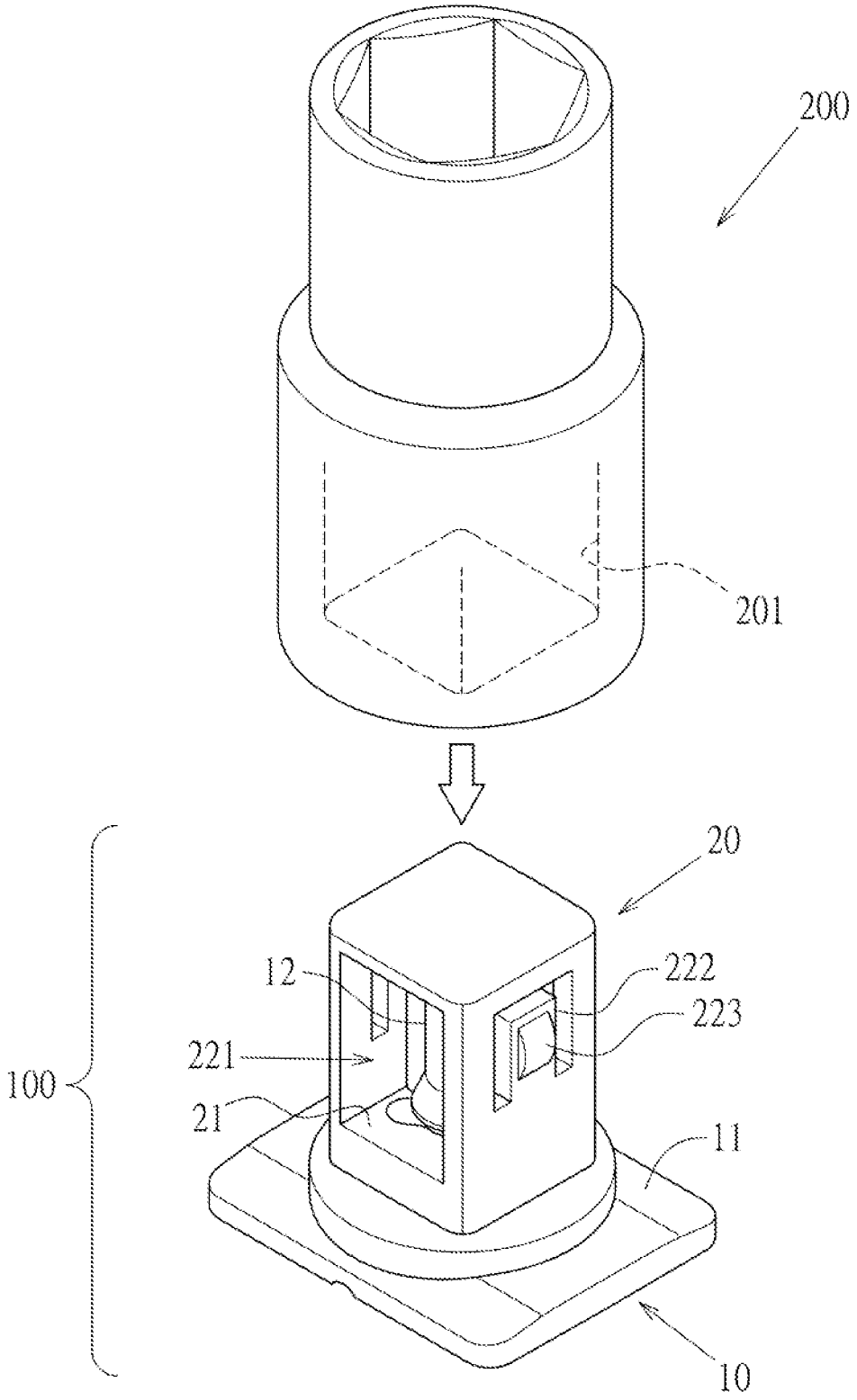
FIG. 1 is a three-dimensional diagram of the tool holder for setting the sleeving tool in the preferred embodiment of the present invention.

FIG. 1 to FIG. 8 show the preferred embodiments of the tool holder of the present invention, but the embodiments are for illustration only, the patent application is not limited to this structure.

The tool holder 100 is provided for placing a sleeving tool 200. The sleeving tool 200 is formed with a quadrangular mouthpiece 201. The tool holder 100 includes a base 10, a rotating sleeve 20, a segmented positioning member 30 and an anti-dropping member 40. The base 10 includes a chassis 11 and a convex shaft 12, the convex shaft 12 is formed with at least one abutment plate 13 extended laterally (note: there are two arranged symmetrically in this case). The rotating sleeve 20 includes a seat 21 and a quadrangular sleeve joint 22. The quadrangular sleeve joint 22 fits the quadrangular mouthpiece 201 of the sleeving tool 200. A hollow chamber 221 is formed in the quadrangular sleeve joint 22. The hollow chamber 221 is formed with at least one elastic piece 222, a blocking part 223 is formed on the outside of the elastic piece 222. When the elastic piece 222 is propped by the at least one abutment plate 13 in hard mode, the blocking part 223 localizes the quadrangular mouthpiece 201 the prevent the sleeving tool 200 from dropping out. The seat 21 is formed with a perforation 23, the contour of the perforation 23 must allow the convex shaft 12 of the base 10 and the at least one abutment plate 13 to pass through and enter the hollow chamber 221. The segmented positioning member 30 includes at least one blocking part 33 and a first inserting part 31 and a second inserting part 32 for the at least one blocking part 33 to optionally engage with. The at least one blocking part 33 is formed on the convex shaft 12 of the base 10. The first inserting part 31 and the second inserting part 32 are formed in the corresponding positions of the seat 21. The anti-dropping member 40 is located in the hollow chamber 221, including an anti-dropping flange 41 laterally expanded and formed at the predetermined height of the convex shaft 12 of the base 10. The anti-dropping flange 41 is elastic and the outside diameter thereof must be larger than the corresponding aperture of the perforation 23. When the convex shaft 12 passes through the perforation 23, the anti-dropping flange 41 forcibly penetrates into the hollow chamber 221 through the perforation 23 in the state of interference fit, so as to prevent the convex shaft 12 from backward dropping out of the hollow chamber 221. Thereby, both the segmented positioning member 30 and the anti-dropping member 40 are arranged in the projection range of the lateral contour of the quadrangular sleeve joint 22.

Figure 7:
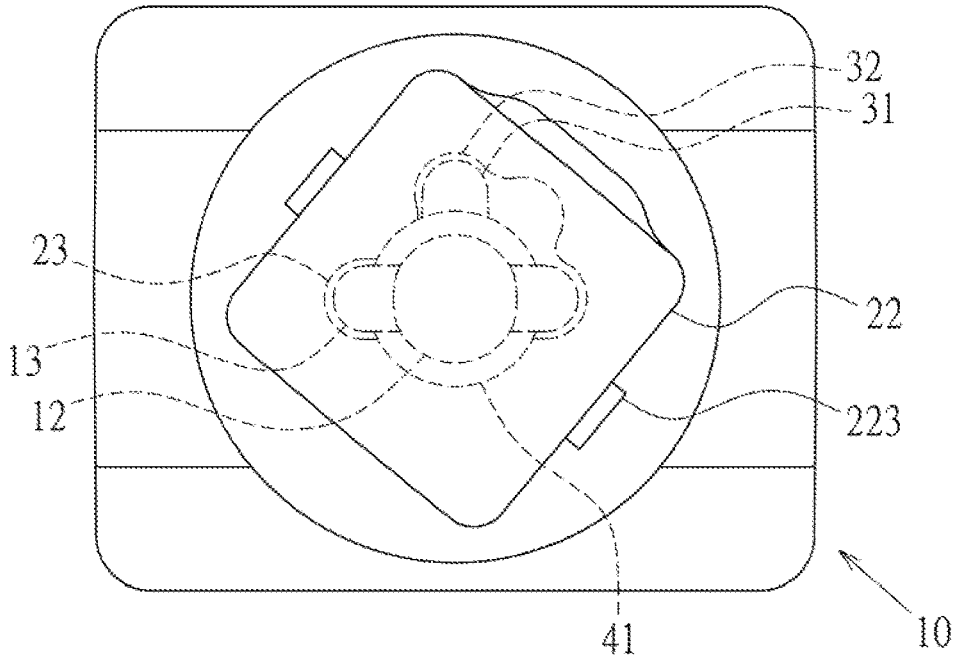
FIG. 7 is a top view of the rotating sleeve rotated to separation angle of the present invention.
Figure 8:
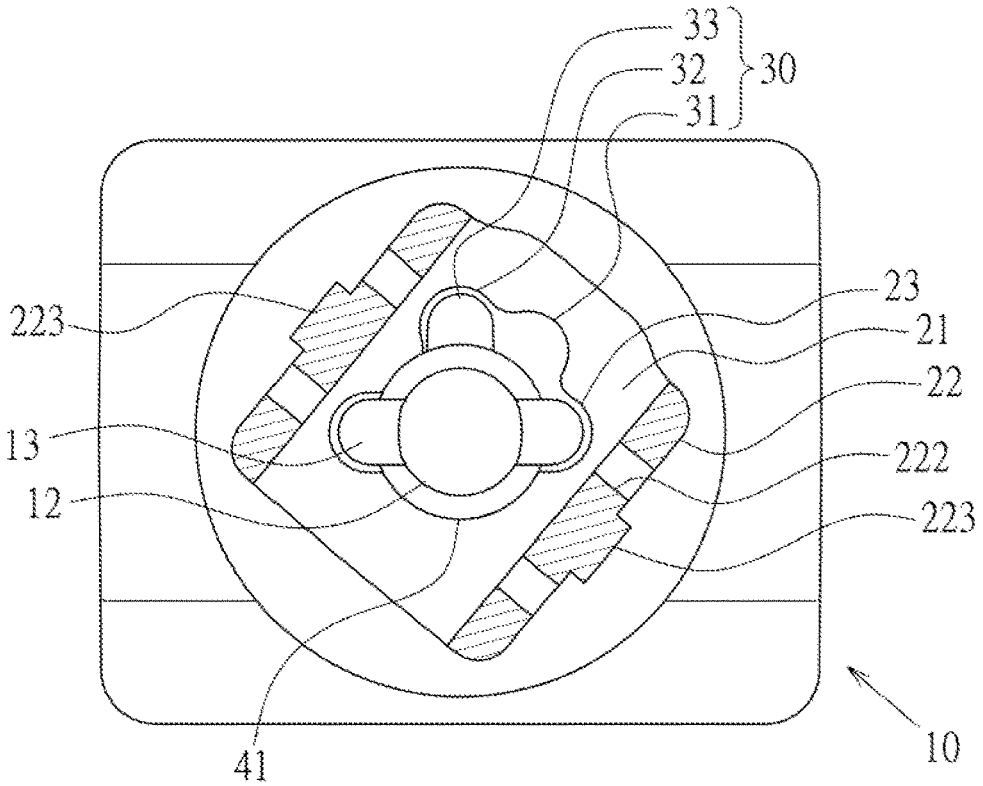
FIG. 8 is a cross-sectional view of partial structure disclosed in FIG. 7.

Based on the aforesaid structure type and technical characteristic, the tool holder 100 disclosed in the present invention is in the preset positioning state in practice, as shown in FIG. 3 to FIG. 6. In this state, the rotation angle of rotating sleeve 20 exactly allows the blocking part 33 to engage with the first inserting part 31, so that the elastic piece 222 is propped by the abutment plate 13 in hard mode, so the blocking part 223 can localize the quadrangular mouthpiece 201 (as shown in FIG. 1) to prevent the sleeving tool 200 from dropping out. Afterwards, as shown in FIG. 7 to FIG. 8, in the preset release condition, the rotation angle of rotating sleeve 20 exactly allows the blocking part 33 to engage with the second inserting part 32, so that the elastic piece 222 is not propped by the abutment plate 13, and the blocking part 223 cannot localize the quadrangular mouthpiece 201 (as shown in FIG. 1), the sleeving tool 200 can drop out. The main claimed effect of the present invention is the innovative configuration that both the segmented positioning member 30 and the anti-dropping member 40 are arranged in the projection range of the lateral contour of quadrangular sleeve joint 22, so that the outside diameter of the tool holder product can be further reduced, better complying with the design development trend of tool product miniaturization.

As shown in FIG. 9 to FIG. 15, in this case, an outer disc 24 outside the projection range of the lateral contour of the quadrangular sleeve joint 22 is extended from the periphery of the seat 21 of the rotating sleeve 20, and a boss 25 is formed on the bottom of the outer disc 24 (note: it is a slot in this case, or it can be a lug). The chassis 11 of the base 10 is formed with a circular guide part 115 (note: it is a lug in this case, or it can be a slot), the circular guide part 115 is provided for setting the boss 25, so as to provide smoother rotating guiding and leaning effect.

Figure 2:
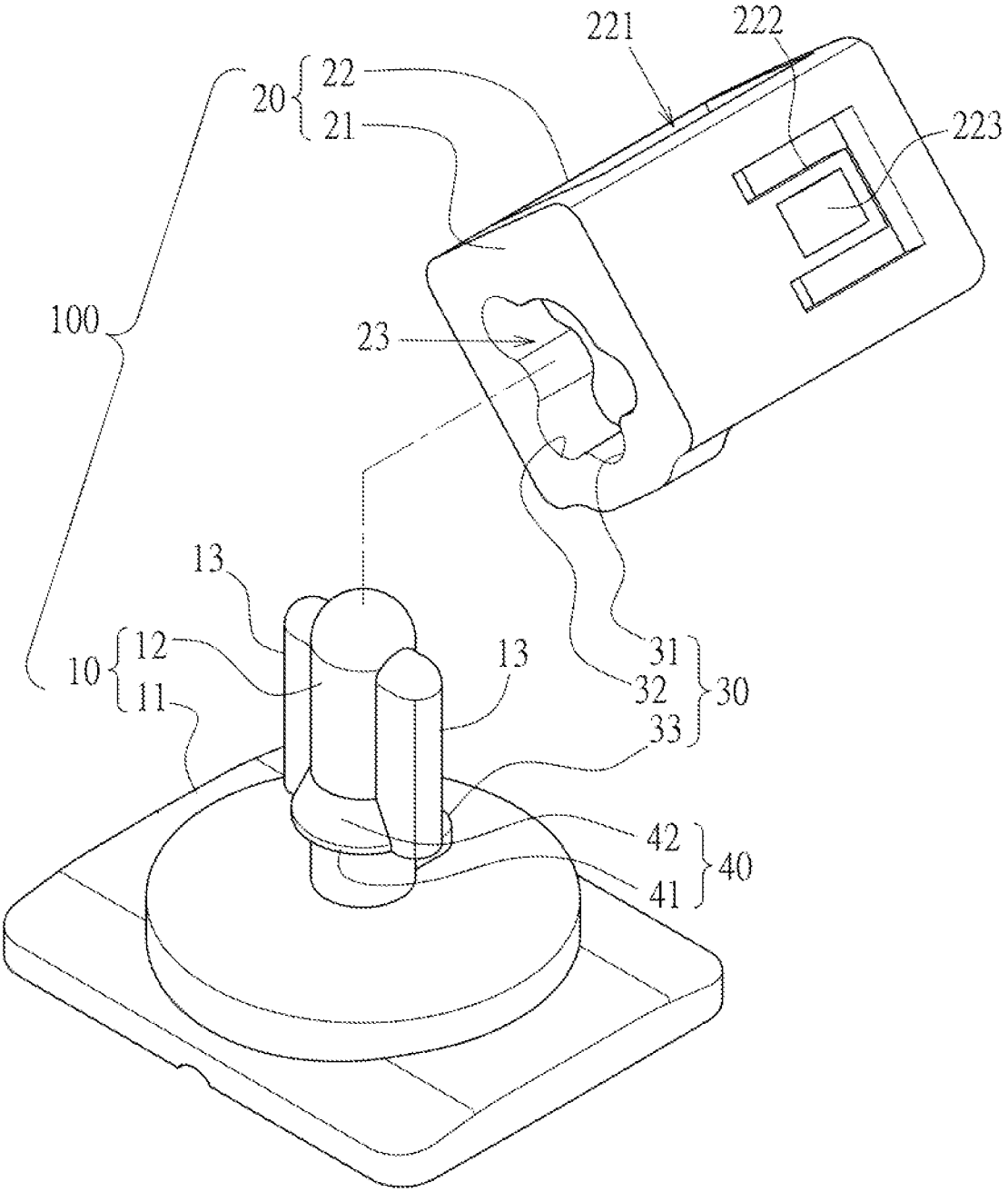
FIG. 2 is a stereogram of the base and rotating sleeve in exploded state in the preferred embodiment of the present invention.
Figure 4:
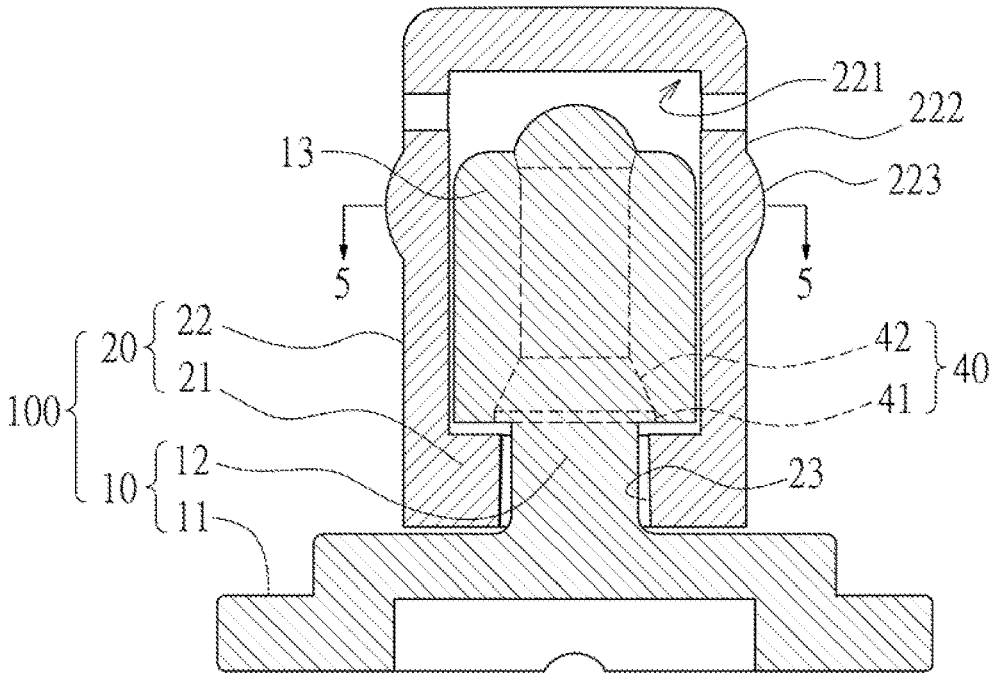
FIG. 4 is a 4-4 sectional view of FIG. 3.
Figure 5:
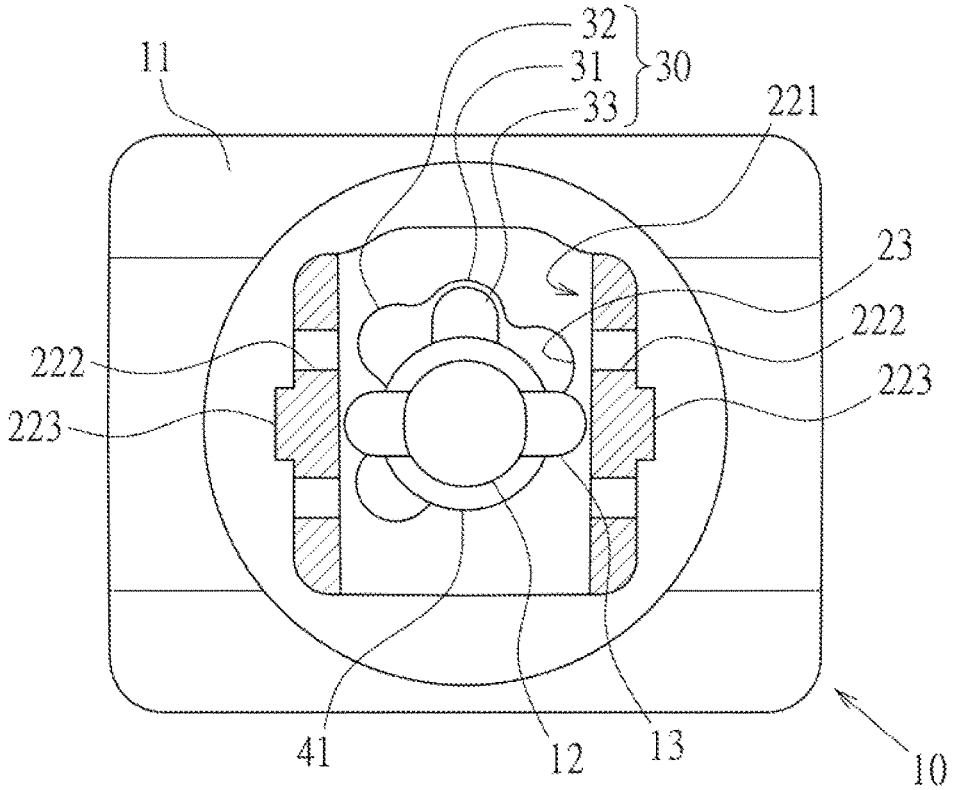
FIG. 5 is a 5-5 sectional view of FIG. 4.
Figure 6:
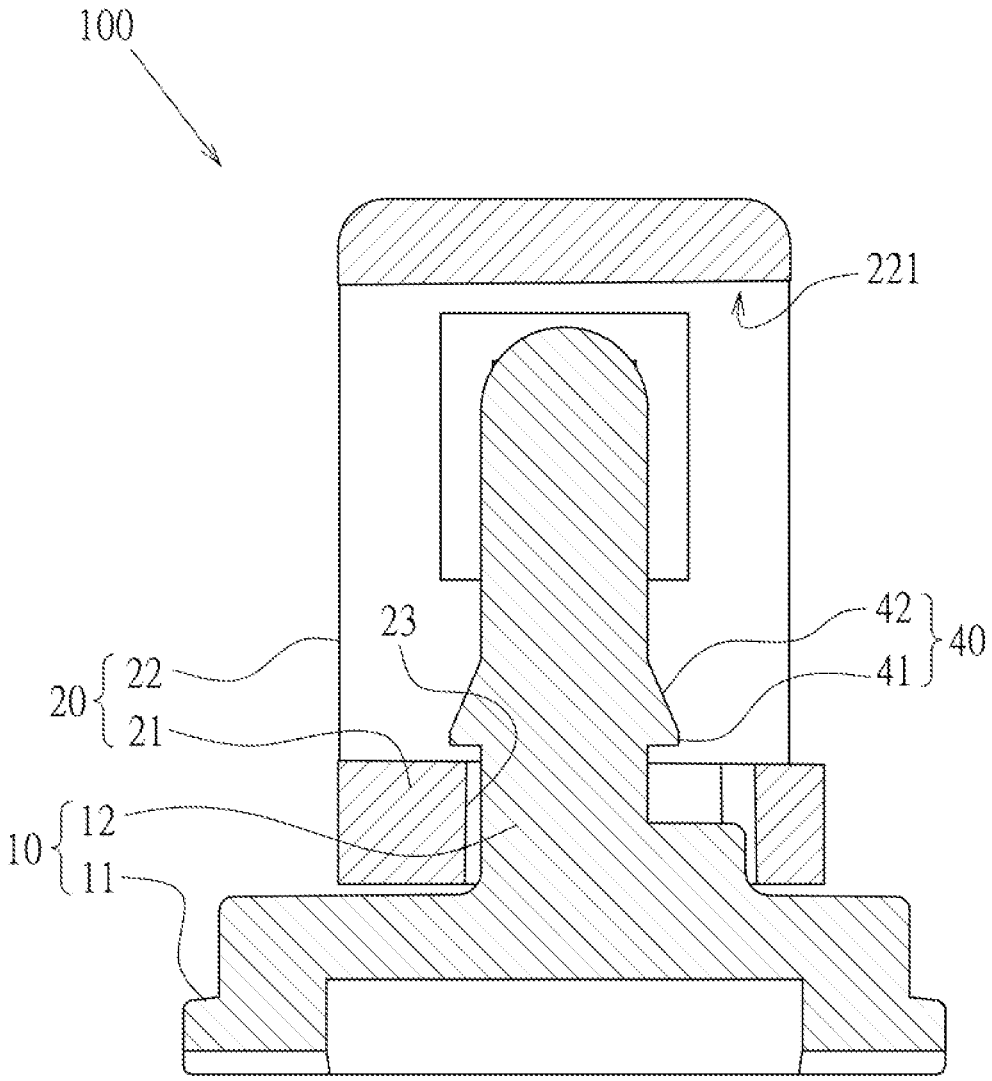
FIG. 6 is a 6-6 sectional view of FIG. 4.

As shown in FIG. 2 and FIG. 4, in this case, the height of the anti-dropping flange 41 is level with the bottom height of the two abutment plates 14.

As shown in FIG. 2 and FIG. 4, in this case, the anti-dropping member 40 includes a bevel guide face 42 which is integrally extended from the anti-dropping flange 41 and connected to the convex shaft 12. In terms of the effect of the bevel guide face 42 in this case, the anti-dropping flange 41 can pass through the perforation 23 more smoothly under the guidance of bevel face.

Figure 16:
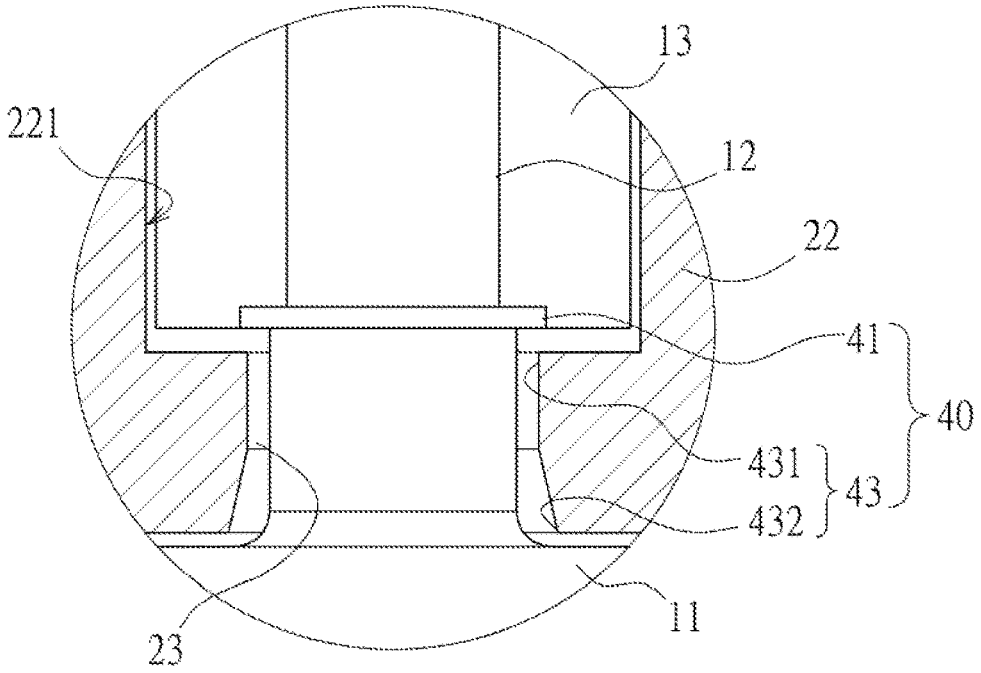
FIG. 16 shows the embodiment of the anti-dropping member of the present invention including a bevel guide lug formed in the perforation.

As shown in FIG. 16, in this case, the anti-dropping member 40 includes a bevel guide lug 43 formed in the perforation 23, the bevel guide lug 43 has a reducing end 431 and an expanding end 432. The bevel guide lug 43 in this case coordinates with the anti-dropping flange 41, the outside diameter of the expanding end 432 is larger than the outside diameter of the anti-dropping flange 41. The outside diameter of the reducing end 431 is smaller than the outside diameter of the anti-dropping flange 41. The effect of the bevel guide lug 43 is as disclosed in previous paragraph, the anti-dropping flange 41 can cross the perforation 23 more smoothly under the guidance of bevel face.

As shown in FIG. 2, in this case, the first inserting part 31 and the second inserting part 32 of the segmented positioning member 30 are formed on partial hole wall of the perforation 23 of the seat 21, forming the configuration that the first inserting part 31, the second inserting part 32 and the perforation 23 are arranged at the same height. The implementation pattern disclosed in this case not only reduces the structure width of the present invention, but also further reduces the height, enhancing the miniaturization.

Figure 3:
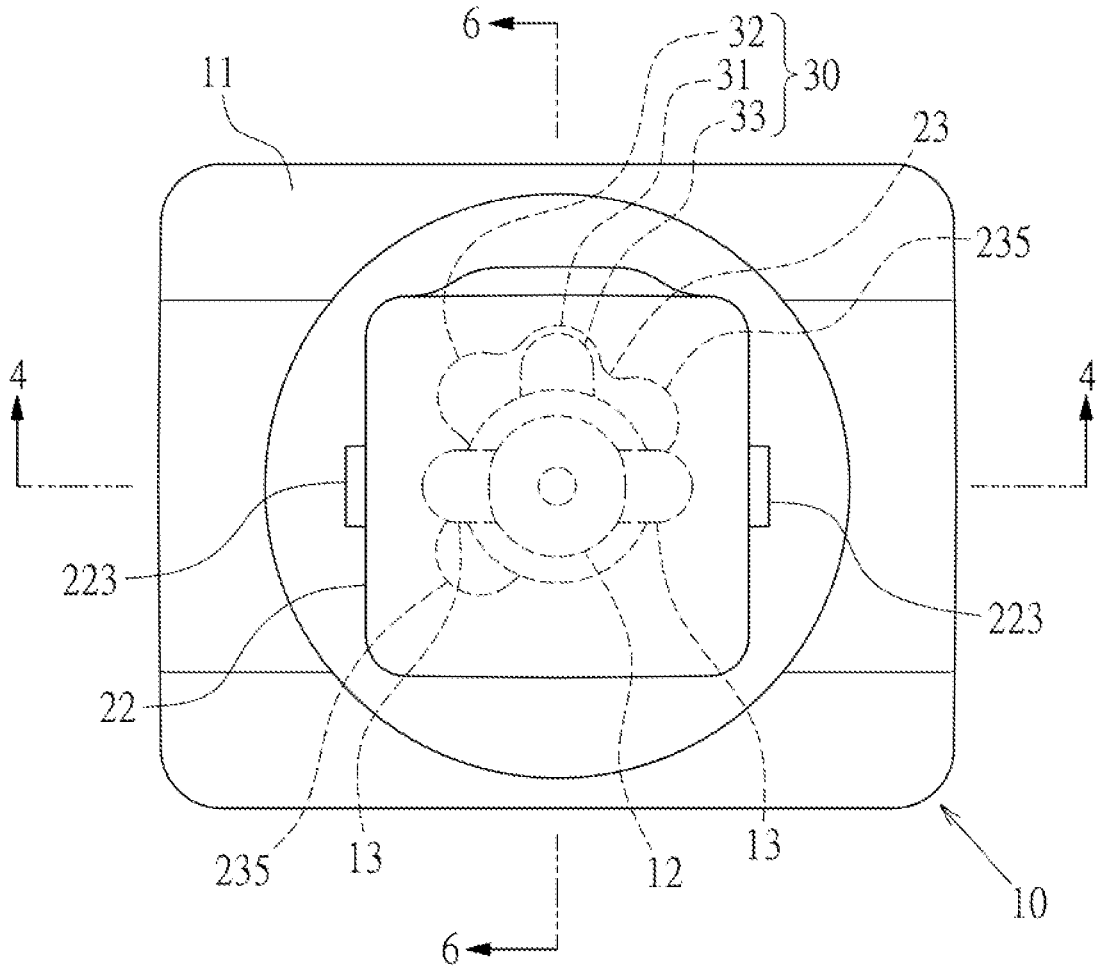
FIG. 3 is a top view of the preferred embodiment of tool holder the present invention.

As shown in FIG. 3, in this case, the perforation 23 is formed with at least one wing hole part 235 fitting the at least one abutment plate 13, so that the first inserting part 31, the second inserting part 32 and the at least one wing hole part 235 are staggered from each other.

Figure 17:
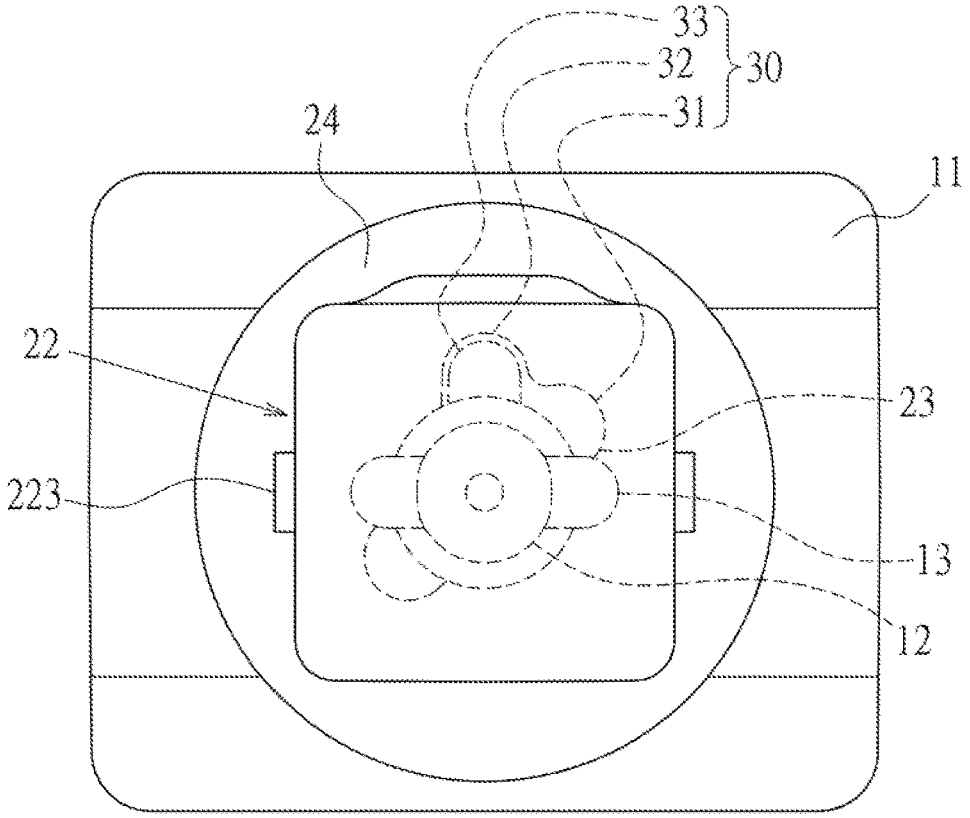
FIG. 17 shows the embodiment of a wing hole part of the perforation of the present invention as the first inserting part.

As shown in FIG. 17, in this case, the perforation 23 is formed with at least one wing hole part (mark number omitted) fitting the at least one abutment plate 13, and one wing hole part is used as the first inserting part 31.

Figure 9:
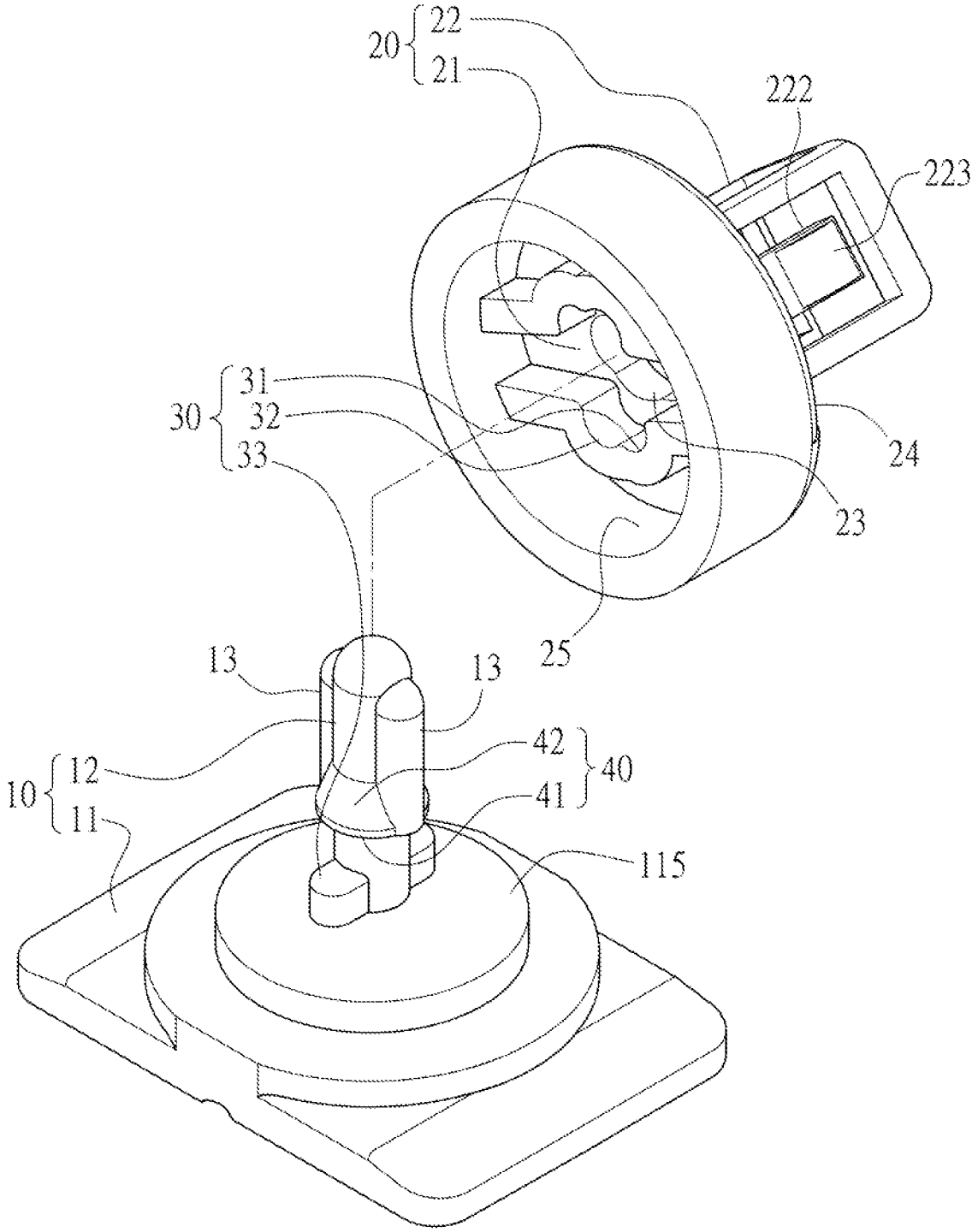
FIG. 9 is a stereogram of the base and rotating sleeve in exploded state in another preferred embodiment of the tool holder of the present invention.
Figure 10:
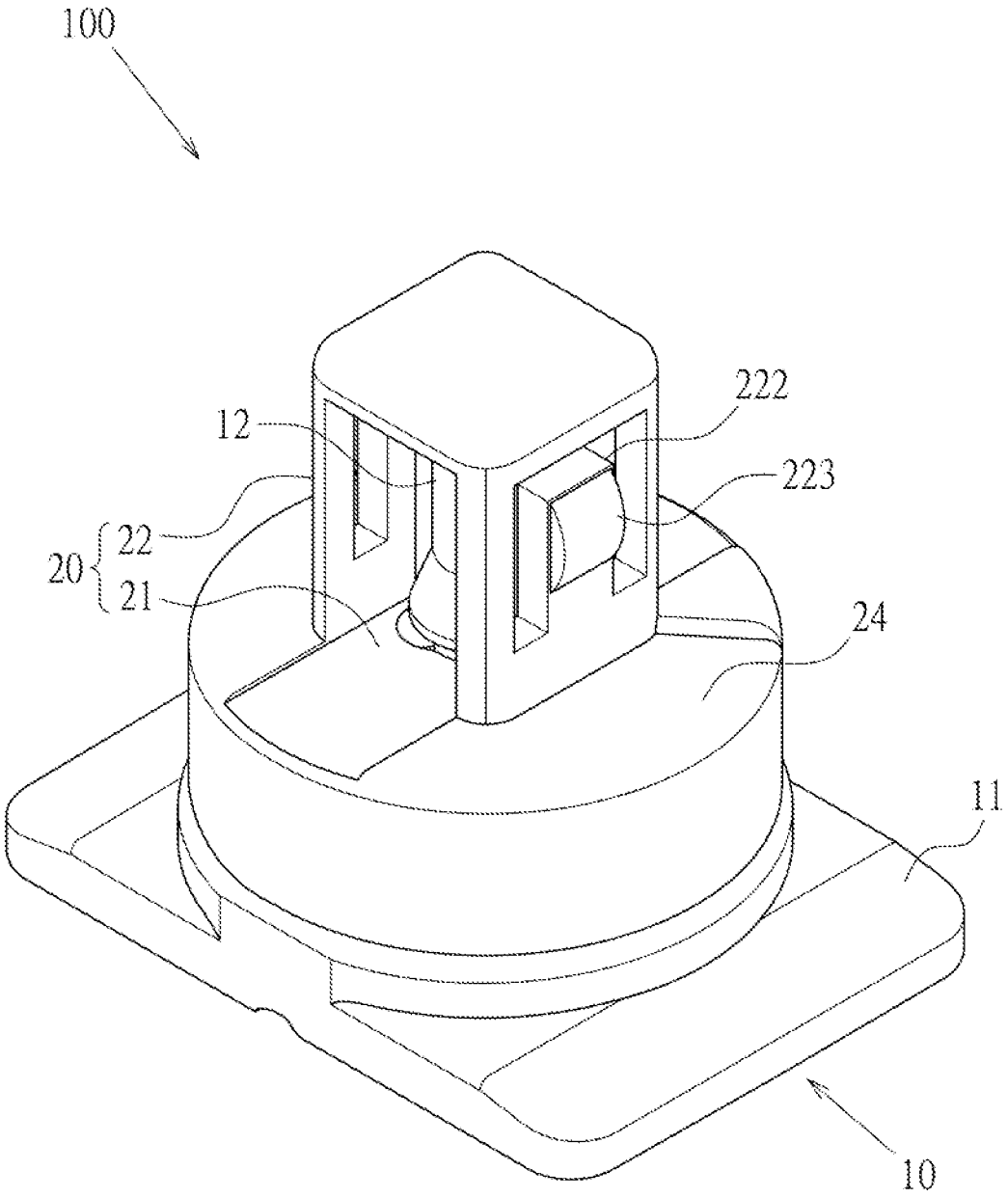
FIG. 10 is a stereogram of the base and rotating sleeve in combined state in another preferred embodiment of the tool holder of the present invention.
Figure 11:
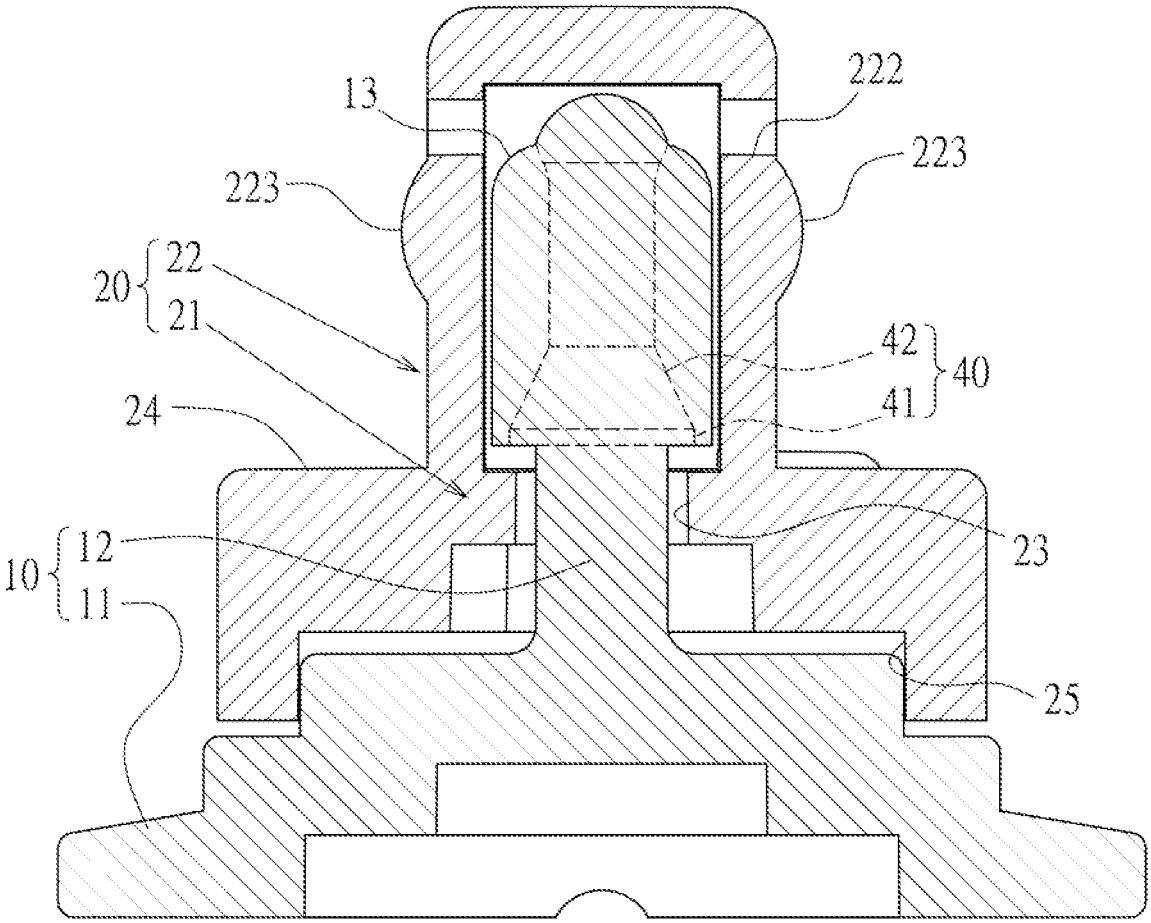
FIG. 11 is a combined section view of the base and rotating sleeve in another preferred embodiment of the tool holder of the present invention.
Figure 12:
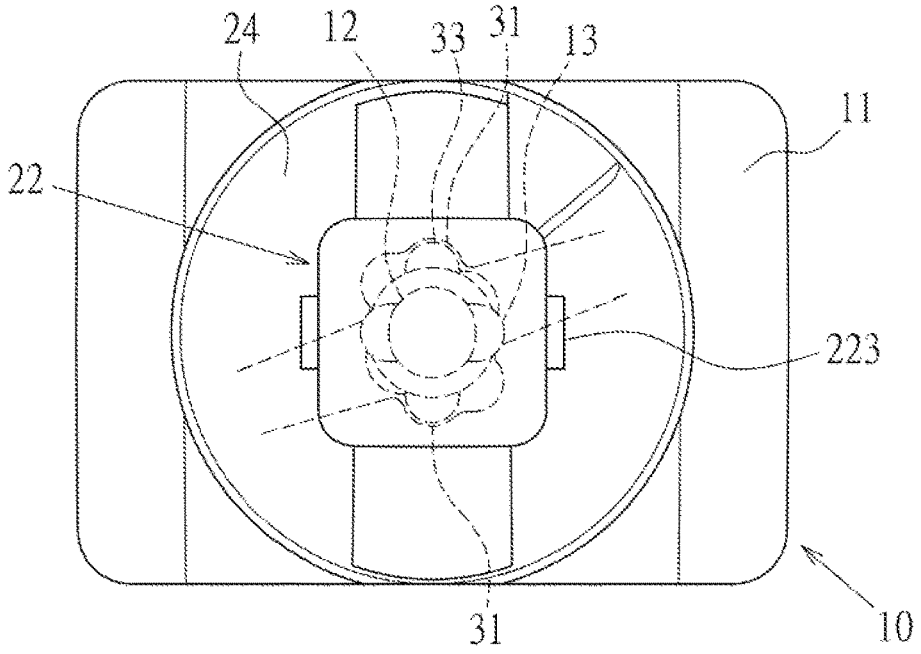
FIG. 12 is a top view of positioning state in another preferred embodiment of the tool holder of the present invention.
Figure 13:
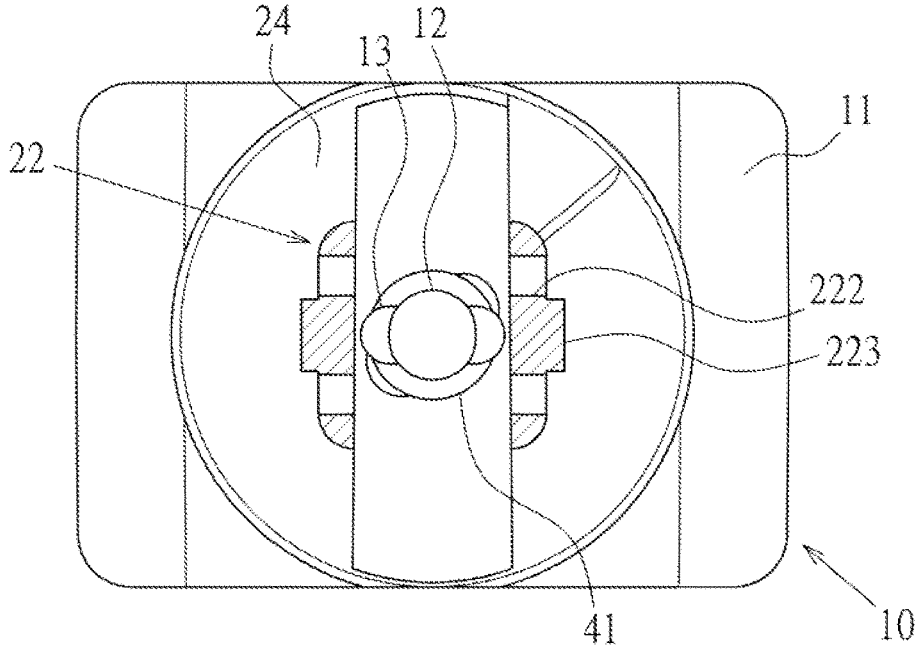
FIG. 13 is a partial cross-sectional view of the state disclosed in FIG. 12.
Figure 14:
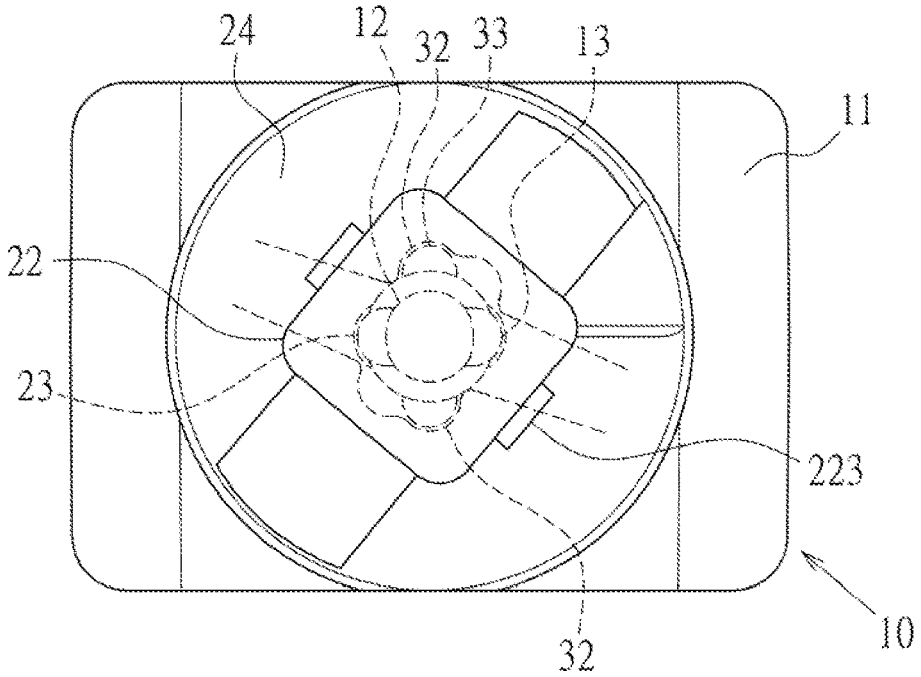
FIG. 14 is a top view of release condition in another preferred embodiment of the tool holder of the present invention.
Figure 15:
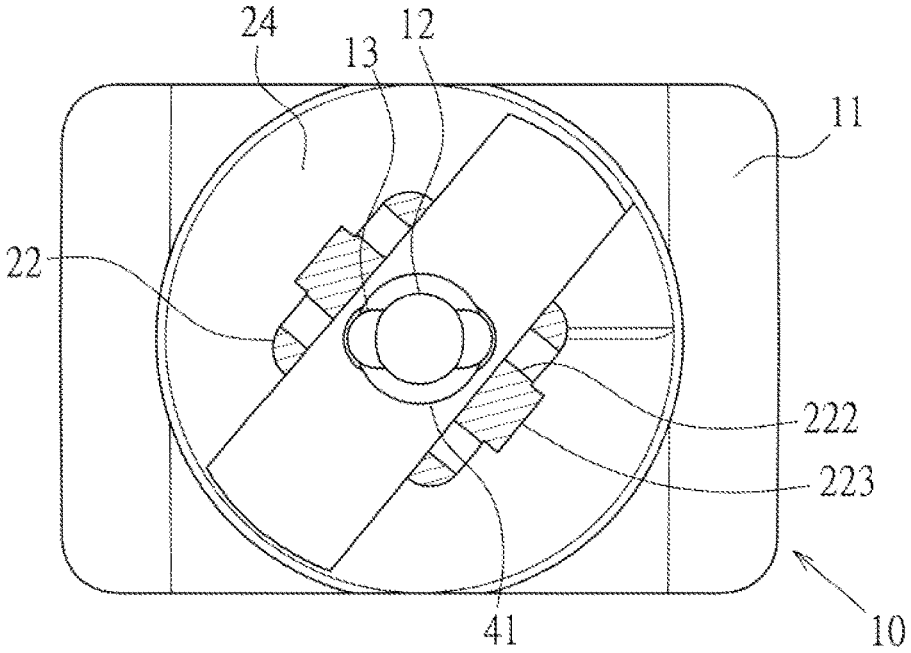
FIG. 15 is a partial cross-sectional view of the state disclosed in FIG. 14.

As shown in FIG. 9, in this case, the first inserting part 31 and the second inserting part 32 of the segmented positioning member 30 are formed on the bottom of the seat 21, forming the configuration that the first inserting part 31, the second inserting part 32 and the perforation 23 are arranged at different heights.

I claim:

1. A tool holder for placing a sleeving tool, the sleeving tool having a quadrangular mouthpiece, the tool holder comprising:

a base having a chassis and a convex shaft, the convex shaft having at least one abutment plate that extends laterally;

a rotating sleeve having a seat and a quadrangular sleeve joint, the quadrangular sleeve joint adapted to set the quadrangular mouthpiece of the sleeving tool, the quadrangular sleeve joint having a hollow chamber therein, the hollow chamber having at least one elastic piece with a blocking part formed on an exterior thereof, the blocking part adapted to localize the quadrangular mouthpiece when the at least one elastic piece is propped by the at least one abutment plate so as to retain the sleeving tool, the seat having a perforation formed therein, the perforation having a contour that allows the convex shaft of said base and the at least one abutment plate to pass through and enter the hollow chamber;

a segmental positioning member having another blocking part and a first inserting part and a second inserting part, the another blocking part being formed on the convex shaft of said base, the first inserting part and the second inserting part being formed in corresponding positions of the seat; and an anti-dropping member positioned in the hollow chamber, said anti-dropping member having a flange extending laterally and formed at a predetermined height of the convex shaft of said base, the flange being elastic, the flange having an outer diameter that is greater than a diameter of the aperture of the seat, the flange forcibly entering in interference fit relation into the hollow chamber through the perforation when the convex shaft passes through the perforation so as to prevent the convex shaft from dropping out of the hollow chamber, wherein said segmental positioning member and said anti-dropping member are arranged in a projection range of the lateral contour of the quadrangular sleeve joint.

2. The tool holder of claim 1, further comprising:

an outer disc extending from a periphery of the seat of said rotating sleeve, said outer disc being outside the projection range of the lateral contour of the quadrangular sleeve joint; and a boss formed on a bottom of said outer disc, the chassis of said base having a circular guide part.

3. The tool holder of claim 1, wherein a height of the flange is level with a bottom of the at least one abutment plate.

4. The tool holder of claim 1, wherein said anti-dropping member has a bevel guide face extending from the flange and connected to the convex shaft.

5. The tool holder of claim 1, wherein said anti-dropping member has a bevel guide lug formed in the perforation, the bevel guide lug having a reducing end and an expanding end.

6. The tool holder of claim 1, wherein the first inserting part and the second inserting part of said segmental positioning member are formed on a hole wall of the perforation of the seat, the first inserting part and the second inserting part and the perforation being arranged at a common height.

7. The tool holder of claim 6, wherein the perforation has at least one wing hole part receiving the at least one abutment plate such that the first inserting part and the second inserting part and the at least one wing hole part are in staggered relation.

8. The tool holder of claim 1, wherein the first inserting part and the second inserting part of said segmental positioning member are formed at a bottom of the seat such that the first inserting part and the second inserting part and the perforation are at different heights.

* * * * *